US009257247B2

(12) United States Patent
Kwa

(10) Patent No.: US 9,257,247 B2
(45) Date of Patent: Feb. 9, 2016

(54) LOW-G MEMS ACCELERATION SWITCH

(71) Applicant: Meggitt (Orange County), Inc., Irvine, CA (US)

(72) Inventor: Tom Kwa, San Jose, CA (US)

(73) Assignee: Meggitt (Orange County), Inc., Irvine, CA (US)

( * ) Notice: Subject to any disclaimer, the term of this patent is extended or adjusted under 35 U.S.C. 154(b) by 0 days.

(21) Appl. No.: 14/300,109

(22) Filed: Jun. 9, 2014

(65) Prior Publication Data

US 2014/0291128 A1 Oct. 2, 2014

Related U.S. Application Data

(63) Continuation of application No. 13/289,993, filed on Nov. 4, 2011, now Pat. No. 8,779,534.

(60) Provisional application No. 61/410,211, filed on Nov. 4, 2010.

(51) Int. Cl.

| | |
|---|---|
| ***H01H 50/10*** | (2006.01) |
| ***H01H 35/14*** | (2006.01) |
| ***H01H 59/00*** | (2006.01) |

(52) U.S. Cl.

CPC ..... *H01H 35/14* (2013.01); *H01H 59/0009* (2013.01); *H01H 35/142* (2013.01)

(58) Field of Classification Search

USPC ..... 257/415; 73/514.24, 778

See application file for complete search history.

(56) References Cited

U.S. PATENT DOCUMENTS

| | | | | |
|---|---|---|---|---|
| 4,855,544 | A | 8/1989 | Glenn | |
| 5,990,427 | A | 11/1999 | Lammert et al. | |
| 7,038,158 | B2 | 5/2006 | Polosky et al. | |
| 2003/0062332 | A1* | 4/2003 | Harris et al. | 216/2 |
| 2005/0126287 | A1 | 6/2005 | Malametz | |
| 2005/0145029 | A1 | 7/2005 | Stewart | |
| 2006/0087390 | A1 | 4/2006 | Yuba et al. | |
| 2007/0196998 | A1* | 8/2007 | Foster et al. | 438/456 |
| 2007/0215964 | A1* | 9/2007 | Khuri-Yakub et al. | 257/414 |
| 2007/0220973 | A1 | 9/2007 | Acar | |
| 2007/0222011 | A1 | 9/2007 | Robert et al. | |
| 2007/0249082 | A1* | 10/2007 | Hanaoka et al. | 438/53 |
| 2008/0099860 | A1* | 5/2008 | Wuertz | 257/415 |

(Continued)

FOREIGN PATENT DOCUMENTS

JP 2005-216552 A 8/2005

OTHER PUBLICATIONS

Extended European Search Report, dated Jul. 3, 2015 for European Application No. EP-12846207.4, based on International Application No. PCT/US2012/062749.

*Primary Examiner* — Thomas L Dickey
(74) *Attorney, Agent, or Firm* — Dickstein Shapiro LLP

(57) ABSTRACT

A motion-sensitive low-G MEMS acceleration switch, which is a MEMS switch that closes at low-g acceleration (e.g., sensitive to no more than 10 Gs), is proposed. Specifically, the low-G MEMS acceleration switch has a base, a sensor wafer with one or more proofmasses, an open circuit that includes two fixed electrodes, and a contact plate. During acceleration, one or more of the proofmasses move towards the base and connects the two fixed electrodes together, resulting in a closing of the circuit that detects the acceleration. Sensitivity to low-G acceleration is achieved by proper dimensioning of the proofmasses and one or more springs used to support the proofmasses in the switch.

16 Claims, 8 Drawing Sheets

(56) References Cited

U.S. PATENT DOCUMENTS

2008/0196502 A1* 8/2008 Fukuda et al. ..... 73/514.38
2009/0139331 A1 6/2009 Axelrod
2010/0213789 A1* 8/2010 Igarashi ..... 310/300
2010/0244160 A1 9/2010 Kanemoto
2010/0295639 A1* 11/2010 Kawabata et al. ..... 335/106
2011/0023606 A1 2/2011 Burghardt et al.
2011/0154905 A1* 6/2011 Hsu et al. ..... 73/724
2011/0203347 A1 8/2011 Hower et al.

* cited by examiner

LOW-G MEMS ACCELERATION SWITCH

RELATED APPLICATIONS

This application is a continuation of U.S. patent application Ser. No. 13/289,993, filed Nov. 4, 2011, which claims the benefit of U.S. Provisional Patent Application No. 61/410,211, filed Nov. 4, 2010 and is titled "Low-G MEMS Acceleration Switch." Both applications are hereby incorporated by reference in their entirety.

BACKGROUND

An inertial switch is a switch that can change its state, e.g., from open to closed, in response to acceleration and/or deceleration. or example, when the absolute value of acceleration along a particular direction exceeds a certain threshold value, the inertial switch changes its state, which change can then be used to trigger an electrical circuit controlled by the inertial switch. Inertial switches are employed in a wide variety of applications such as automobile airbag deployment systems, vibration alarm systems, detonators for artillery projectiles, and motion-activated light-flashing footwear.

A conventional inertial switch is a relatively complex, mechanical device assembled using several separately manufactured components such as screws, pins, balls, springs, and other elements machined with relatively tight tolerance. As such, conventional inertial switches are relatively large (e.g., several centimeters) in size and relatively expensive to manufacture and assemble. In addition, conventional inertial switches are often prone to mechanical failure.

One acceleration switch is manufactured using a layered wafer and has a movable electrode supported on a substrate layer of the wafer and a stationary electrode attached to that substrate layer. he movable electrode is adapted to move with respect to the substrate layer in response to an inertial force such that, when the inertial force per unit mass reaches or exceeds a contact threshold value, the movable electrode is brought into contact with the stationary electrode, thereby changing the state of the inertial switch from open to closed. The MEMS device is a substantially planar device, designed such that, when the inertial force is parallel to the device plane, the displacement amplitude of the movable electrode from a zero-force position is substantially the same for all force directions.

There is a need for a low-G MEMS acceleration switch. There is a further need for a MEMS acceleration switch that is insensitive to transverse loads. There is a further need for a MEMS acceleration switch that does not have the current flow through the entire device and provides for lower resistance in the closed state.

The foregoing examples of the related art and limitations related therewith are intended to be illustrative and not exclusive. Other limitations of the related art will become apparent upon a reading of the specification and a study of the drawings.

BRIEF DESCRIPTION OF THE DRAWINGS

This patent or application file contains at least one drawing executed in color. Copies of this patent or patent application publication with color drawing(s) will be provided by the Office upon request and payment of the necessary fee.

DETAILED DESCRIPTION OF THE EMBODIMENTS

The device is illustrated by way of example and not by way of limitation in the figures of the accompanying drawings in which like references indicate similar elements. It should be noted that references to "an" or "one" or "some" embodiment (s) in this disclosure are not necessarily to the same embodiment, and such references mean at least one.

A motion-sensitive low-G MEMS acceleration switch, which is a MEMS switch that closes at low-g acceleration (e.g., sensitive to no more than 10 Gs), is proposed. Specifically, the low-G MEMS acceleration switch has a base, a sensor wafer with one or more proofmasses, an open circuit that includes two fixed electrodes, and a contact plate. During acceleration, one or more of the proofmasses move towards the base and connects the two fixed electrodes together, resulting in a closing of the circuit that detects the acceleration. Sensitivity to low-G acceleration is achieved by proper dimensioning of the proofmasses and one or more springs used to support the proofmasses in the switch. In addition to high sensitivity in the direction of interest, the proposed switch is insensitive to transverse loads during acceleration and does not have the current flow through the entire device thereby providing for lower resistance in the closed circuit state.

Figure 1:
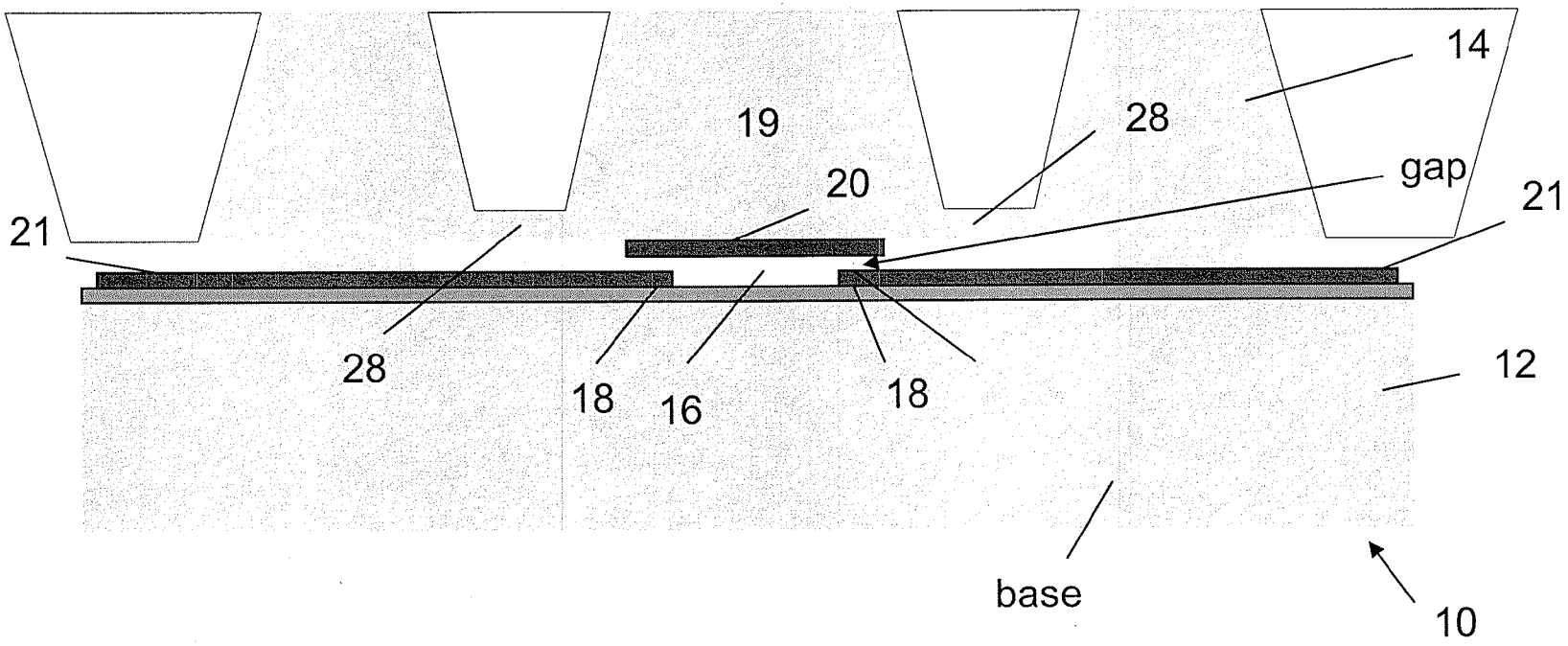
FIG. 1 illustrates an example of a MEMS acceleration switch of the present invention that has a base, sensor wafer and an open circuit.

FIG. 1 illustrates an example of a MEMS acceleration switch that has a base, sensor wafer and an open circuit. In the example of FIG. 1, MEMS acceleration switch 10 includes a base 12 made of materials such as Si and the like, and a sensor wafer 14. Under acceleration, one or more proofmasses 19 of the sensor wafer 14 moves towards the base 12 which has an open circuit, generally denoted as 16 (one or more springs 28 can be used to support the proofmasses 19 as shown in FIGS. 5-8). The open circuit 16 is positioned between the base 12 and the sensor wafer 14. The open circuit 16 includes two fixed electrodes 18 and a contact plate 20. During acceleration, the proofmass 19 with contact plate 20 moves towards the base 12 and connects the two electrodes 18, resulting in a closing of the circuit. Electrical contact to the switch is achieved with wires, not shown, bonded to wire bondpads 21.

In various other embodiments, the low-G MEMS acceleration switch 10 for activation at a load less than 10 G may be dimensioned for a lower G activation load that does not exceed 5 G, 3 G, 2 G and the like.

In some embodiments, the MEMS acceleration switch 10 is substantially insensitive to transverse load, which is a load applied in a direction perpendicular to the intended axis of measurement (sensitive axis), with zero or minimum displacement along the sensitive axis when the transverse load is applied, e.g., a given transverse load results in less than 1% of displacement along the sensitive axis than if the same axial load is applied along the sensitive axis, i.e., the axis of measurement. As such, the MEMS acceleration switch 10 provides a displacement along the sensitive axis that is substantially independent of the transverse load. As such, the MEMS acceleration switch 10 provides a displacement along the sensitive axis that is substantially independent of the transverse load. In addition, a transverse load as high as 10 times (or more) than the nominal range (e.g., anywhere between 1 and 10 Gs) does not result in closure of the switch.

Figure 2:
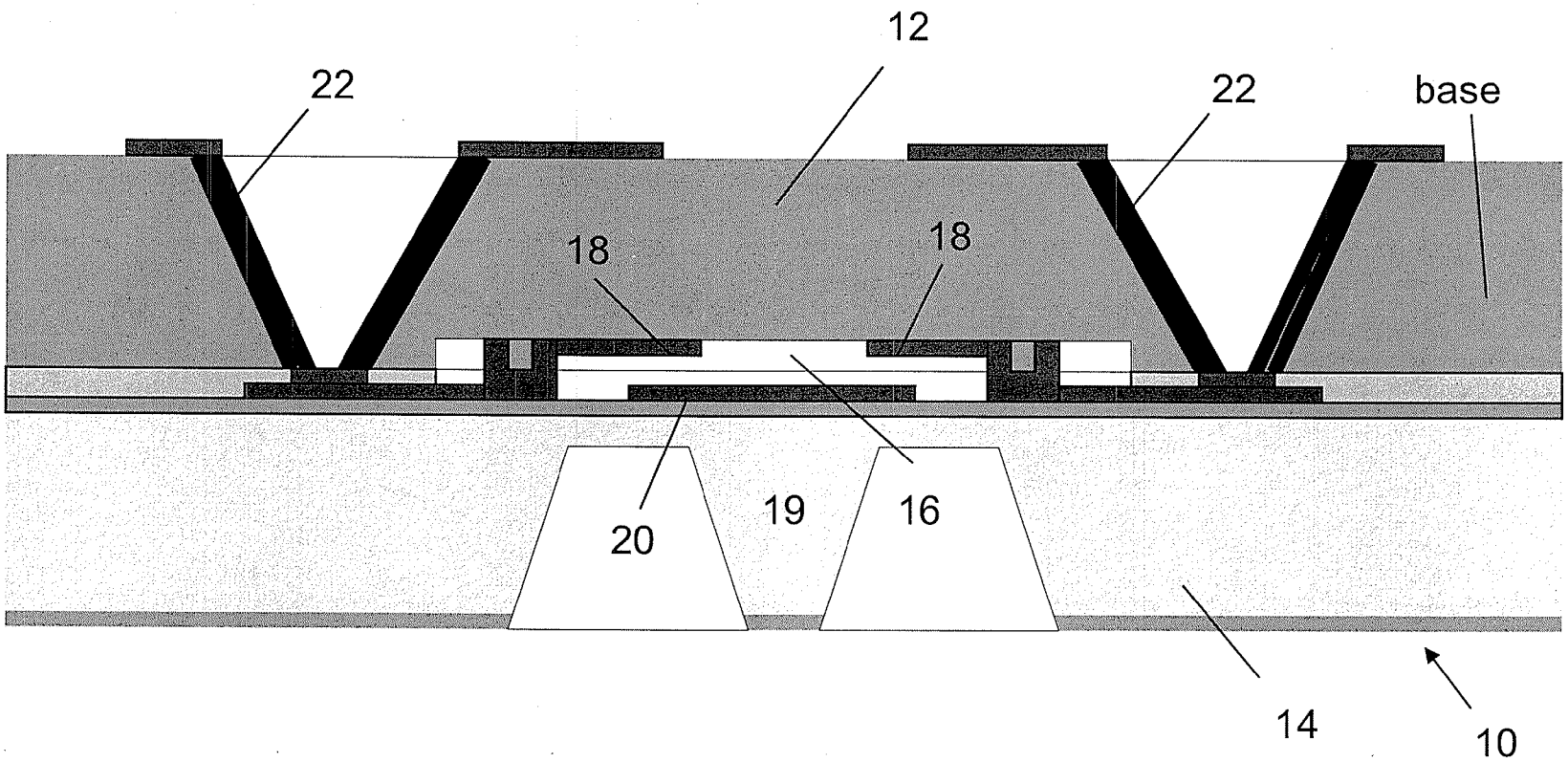
FIG. 2 illustrates an example of an embodiment similar to that of FIG. 1 except it is a flip chip version.
Figure 3:
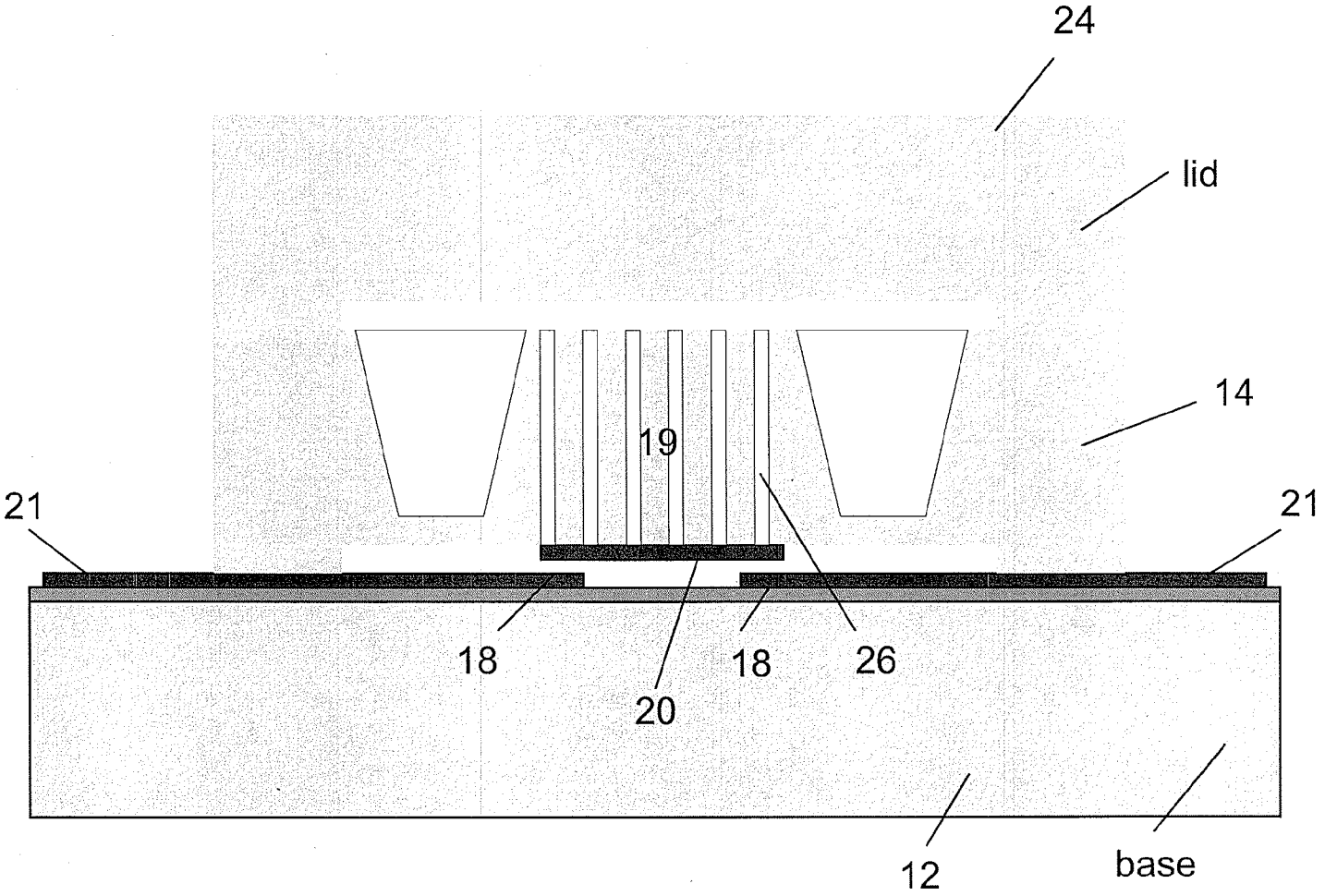
FIG. 3 illustrates an example of an embodiment similar to the FIG. 1 embodiment except it is a triple stack that includes a lid and the proofmass has apertures for damping.

FIG. 2 illustrates an example of an embodiment of the MEMS acceleration switch similar to that of FIG. 1 except it is a flip chip version where the base 12 is on the top and proofmass 19 is still within sensor wafer 14. In the example of FIG. 2, vias 22 for electrical contact to the switch are provided in place of wire bondpads. The benefit of the flip chip design depicted in FIG. 2 is that the switch can be flip chip mounted on a substrate or circuit board rather than mounted on the substrate with an adhesive and connected to the substrate via bonded wires FIG. 3 illustrates an example of an embodiment similar to the FIG. 2 embodiment except it is a triple stack that includes a lid 24. In the example of FIG. 3, the proofmass 19 has one or more apertures 26 for damping in the event that the MEMS acceleration switch 10 needs to be a damped switch. Wire bondpads 21 are provided.

Figure 4:
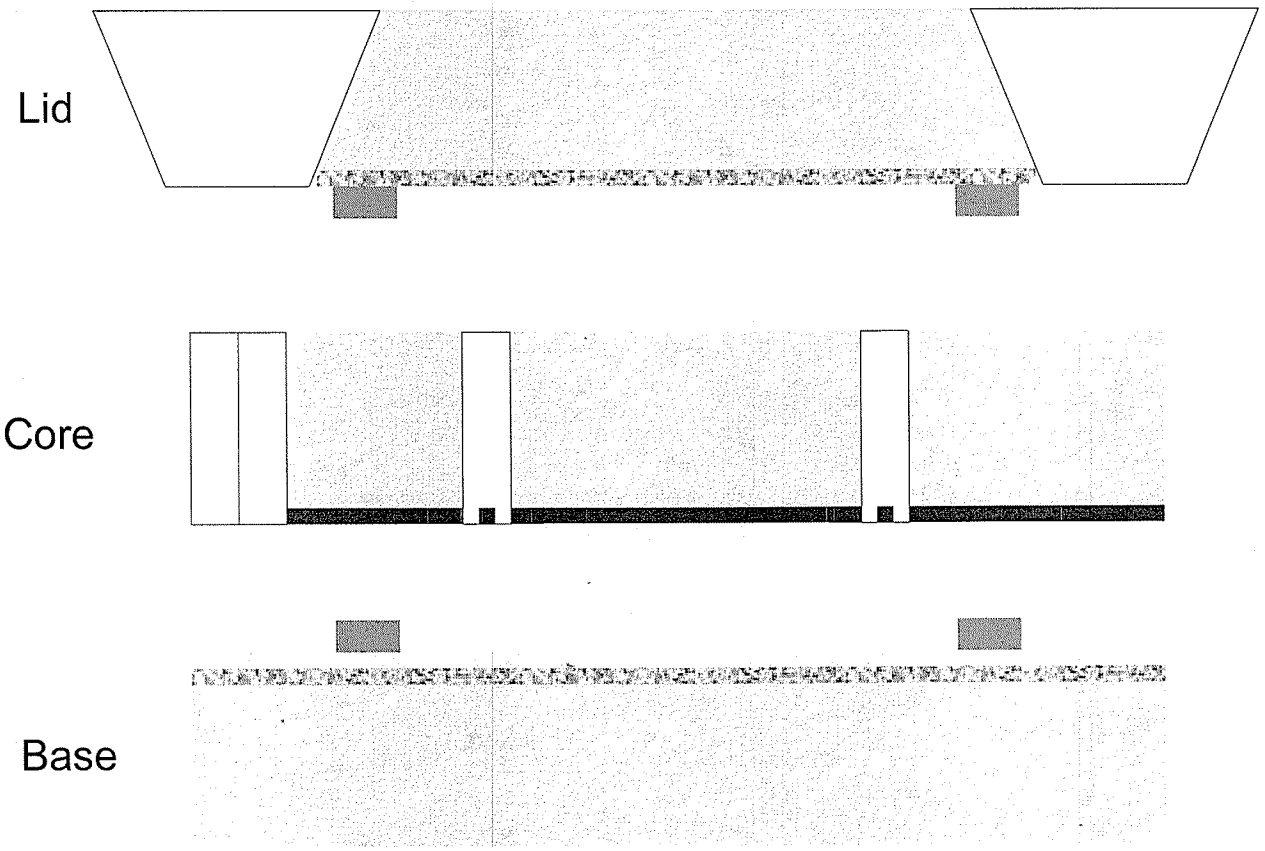
FIG. 4 illustrates an example of one embodiment of a process for making the MEMS acceleration switch depicted in FIG. 3.

FIG. 4 illustrates an example of one embodiment of a process for making the MEMS acceleration switch depicted in FIG. 3. The device is made from a stack of three wafers—a lid, a core, and a base, which are bonded using any suitable bonding technique, such as solderglass bonding. The core wafer is fabricated from an SOI wafer. A photo mask defines the areas from which the subsequent DRIE etch from the back of the wafer will remove bulk silicon. The etch stops on the buried oxide. A photo mask applied to the front of the wafer then defines and an RIE etch forms the springs and the proofmass. Finally, a metal deposition (e.g, gold), a photo mask and a metal etch define and form the contact plate. The three wafers are then bonded. The spring thickness can be defined by the device layer of an SOI wafer.

Figure 5:
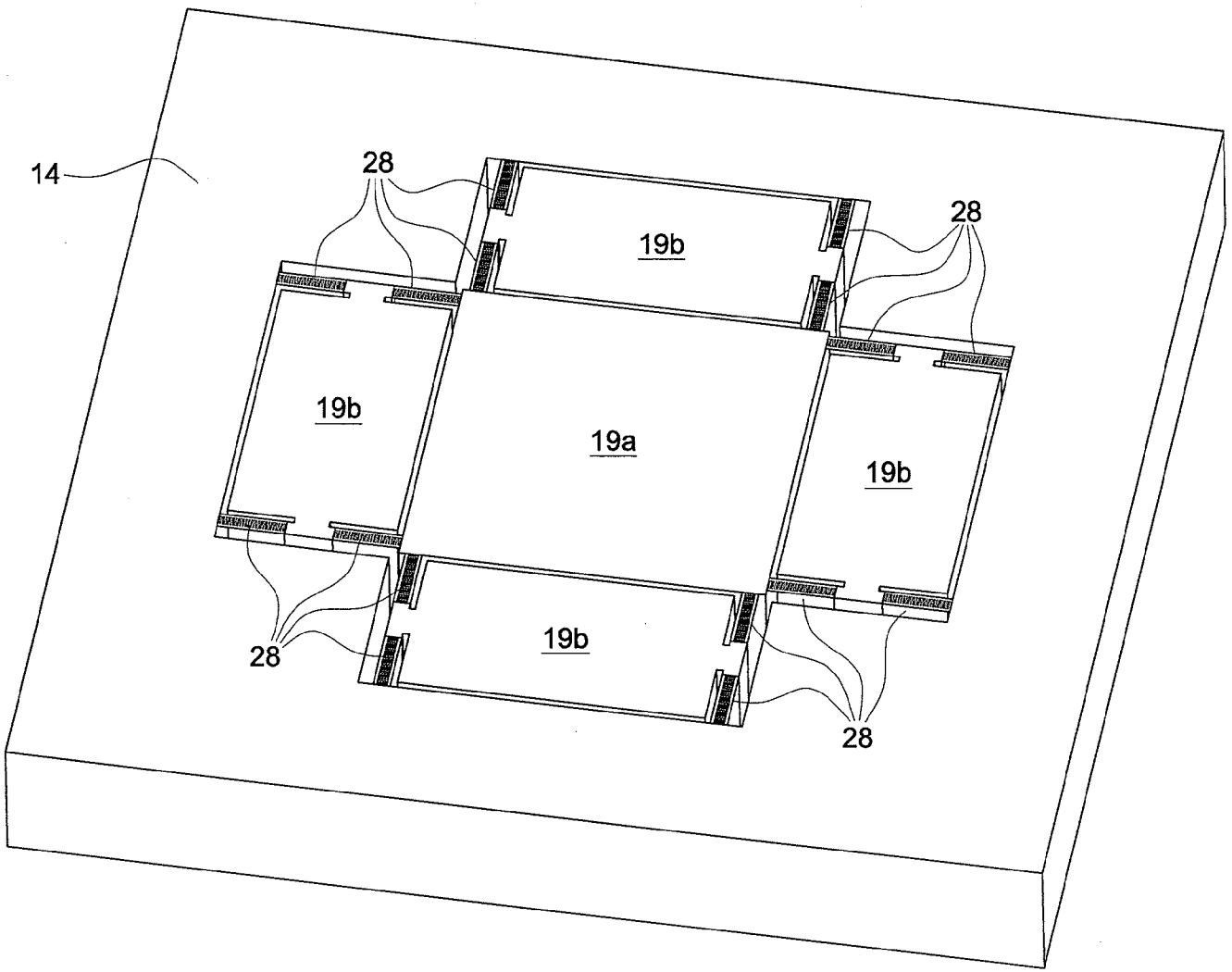
FIG. 5 illustrates an example of an embodiment of a MEMS acceleration switch with springs that support a central proofmass and additional proofmasses in a surrounding relationship to the central proofmass.

FIG. 5 illustrates an example of an embodiment of the sensor wafer 14 of the MEMS acceleration switch 10 with springs that support a central proofmass and additional proofmasses at the exterior of and in a surrounding relationship to the central proofmass. In the example of FIG. 5, which shows the sensor wafer only, the MEMS acceleration switch 10 has springs 28 that support a central proofmass 19*a* and additional proofmasses 19*b* in a surrounding relationship to the central proofmass 19*a*. Such arrangement of springs and the proofmasses allows the proofmasses to move and actually increases the displacements of the proofmasses during acceleration.

In the example of FIG. 5, springs 28 can be connected along their lengths by coupling rungs, and are configured and constructed for maximum displacement along the intended axis of measurement (the sensitive axis) for axial loads (vs. transverse loads). In some embodiments, springs 28 are in pairs and separated by a mass that can be a solid block made of a material such as silicon, silicon carbide and the like. In some embodiments, at least one pair of springs 28 is on the top (front) side of the wafer. This provides a great deal of displacement, e.g., 2 to 10 um.

Figure 6:
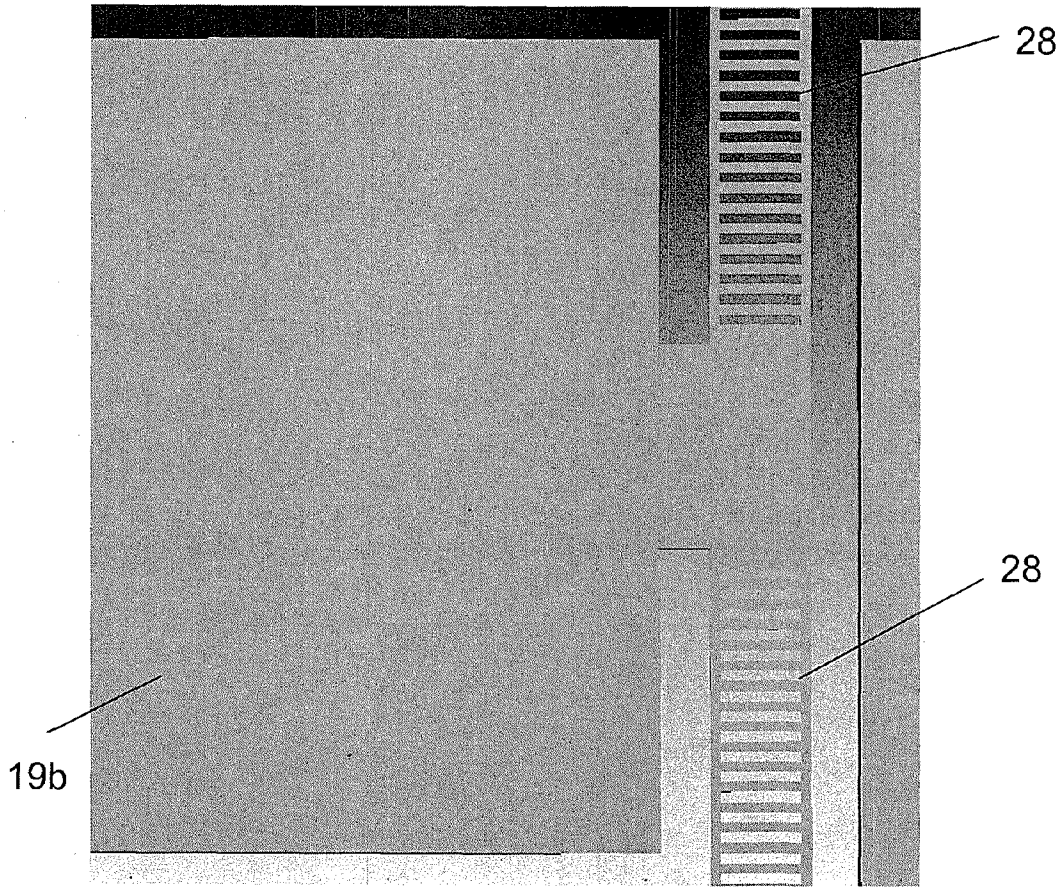
FIG. 6 illustrates an example of an embodiment of the spring system in the MEMS acceleration switch depicted in FIG. 5.

In some embodiment and as illustrated by the example depicted in FIG. 6, the springs 28 are single-sided and positioned on only one side of the sensitive wafer 14 and each spring includes a pair of relatively long (e.g., 100-500 um), thin (e.g., 5-20 um) and narrow (e.g., 5-20 um) beams connected by coupling rungs. The low length-to-width aspect ratio of the overall spring restricts displacement due to lateral forces while the small thickness allows for maximum displacement due to perpendicular forces. Additionally, since a switch with single-sided springs has a smaller spring constant resulting in larger displacement from axial and transverse loads, such acceleration switch with single-sided springs is sensitive to transverse load, which may result in 10-30% of displacement along the sensitive axis if axial load is applied along the sensitive axis.

Figure 7:
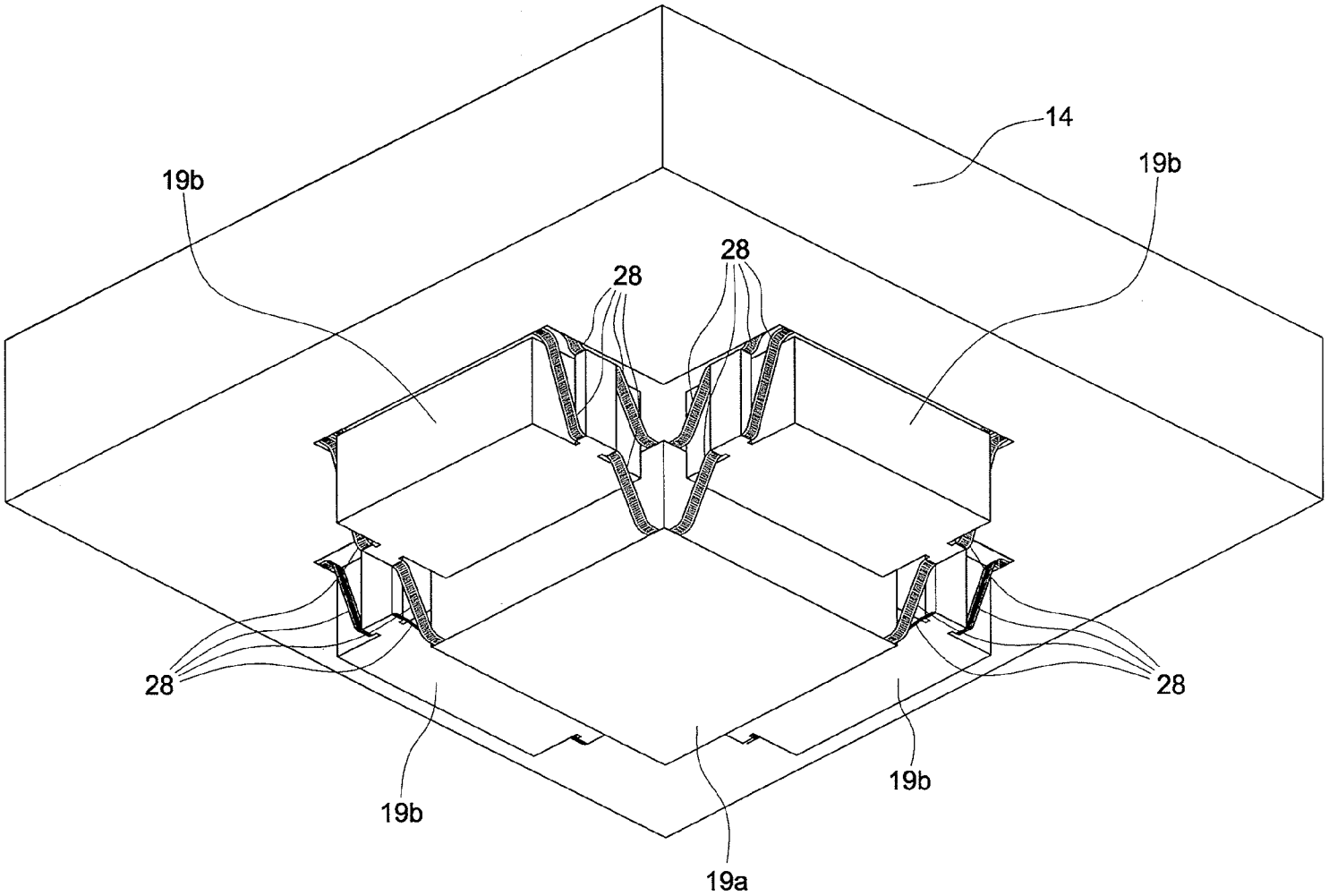
FIG. 7 illustrates an example of an embodiment of a MEMS acceleration switch with double sided springs on opposite sides of the wafer in order to decrease sensitivity for transverse loads.

FIG. 7 illustrates an example of an embodiment of the sensor wafer 14 of a low-G MEMS acceleration switch with double sided springs on two/opposite sides of the sensor wafer. The effect is a decrease in sensitivity for transverse loads. For a non-limiting example, a given transverse load results in less than 1% of displacement along the sensitive axis if the same axial load is applied along the sensitive axis.

Figure 8:
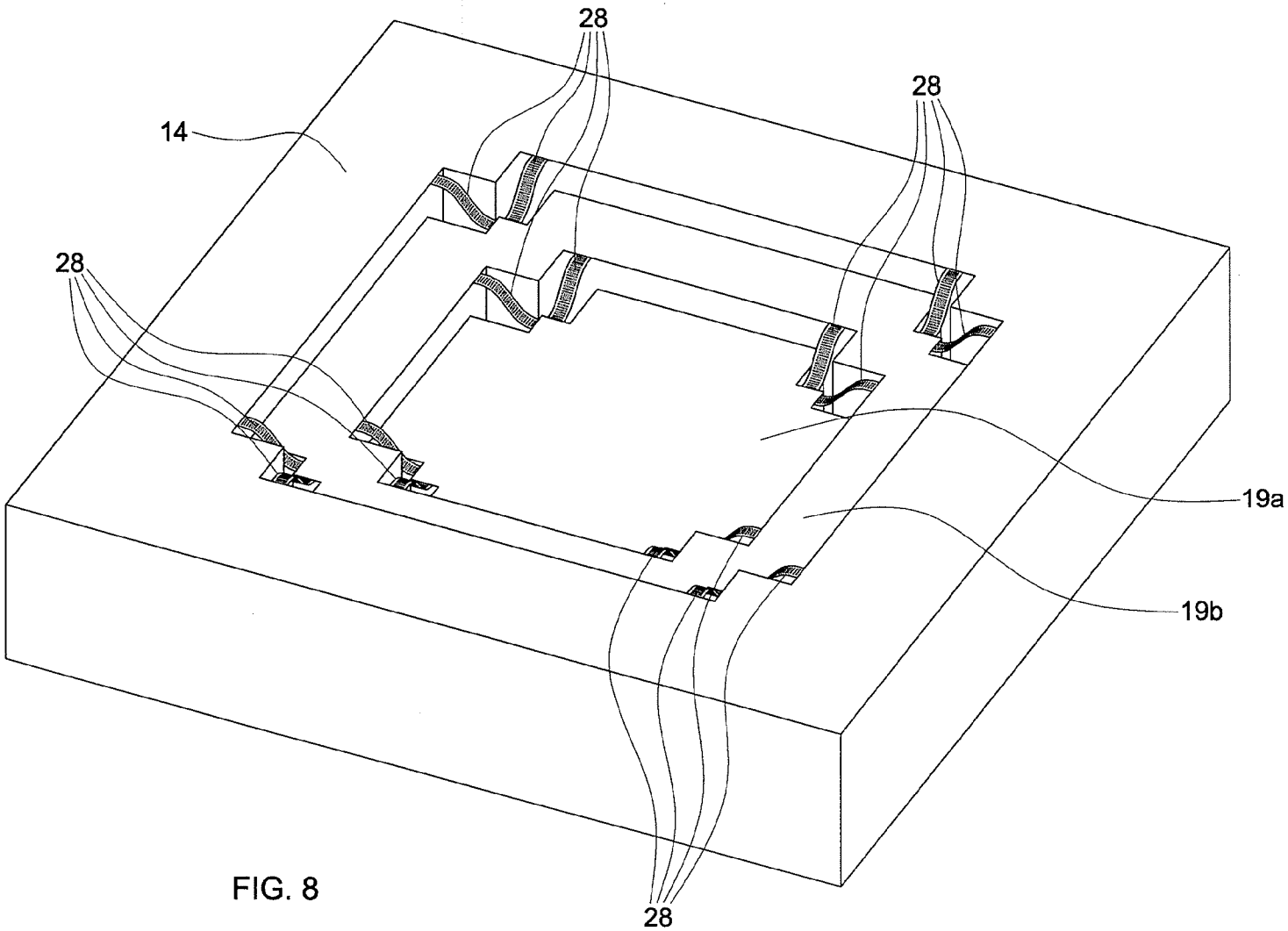
FIG. 8 illustrates an example of an embodiment of a low-G MEMS acceleration switch with double sided springs that are connected to corners instead of at the sides.

FIG. 8 illustrates an example of an embodiment of the sensor wafer 14 a low-G MEMS acceleration switch with double sided springs 28 that are connected to corners instead of at the sides as shown in FIGS. 5-7. Such spring arrangement provides for increased displacement, which comes from rearranging the springs compared to FIG. 7 (although it also has double-sided springs), thereby improving manufacturability.

While the invention has been described and illustrated with reference to certain particular embodiments thereof, those skilled in the art will appreciate that various adaptations, changes, modifications, substitutions, deletions, or additions of procedures and protocols may be made without departing from the spirit and scope of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the appended claims.

What is claimed is:

1. A MEMS acceleration switch comprising:

a base;

a first electrode coupled to the base;

a second electrode coupled to the base and spaced apart from the first electrode;

an SOI wafer comprising:

a proofmass comprising multiple layers of the SOI wafer and formed by etching into the SOI wafer around the proofmass down to a device layer, wherein the proofmass is coupled to the SOI wafer only by portions of the device layer surrounding the proofmass; and, a contact plate coupled to the SOI wafer adjacent the proofmass;

wherein the base is coupled to and spaced apart from the SOI wafer such that the contact plate forms a gap with the first and second electrodes and the proofmass is designed to translate with respect to the SOI wafer such that the contact plate closes the gap under an acceleration and electrically connects the first and second electrodes.

2. The MEMS acceleration switch of claim 1, wherein the switch is a flip chip.

3. The MEMS acceleration switch of claim 2, further comprising a plurality of vias that provide electrical communication from the first and second electrodes through the base to an opposite side of the base from the first and second electrodes.

4. The MEMS acceleration switch of claim 1, further comprising a lid coupled to the SOI wafer.

5. The MEMS acceleration switch of claim 1, wherein the portions of the device layer surrounding the proofmass are substantially thinner than the proofmass.

6. The MEMS acceleration switch of claim 1, wherein the portions of the device layer surrounding the proofmass are springs.

7. The MEMS acceleration switch of claim 1, wherein the portions of the device layer surrounding the proofmass have a thickness defined by the device layer.

8. The MEMS acceleration switch of claim 1, wherein the portions of the device layer surrounding the proofmass form discrete connections to the surrounding SOI wafer and other portions of the device layer surrounding the proofmass have been completely removed to form the discrete connections.

9. A method of making a MEMS acceleration switch comprising:

forming a base;

coupling a first electrode to the base;

coupling a second electrode to the base spaced apart from the first electrode;

coupling a SOI wafer to the base;

forming a proofmass from multiple layers of the SOI wafer by etching into the SOI wafer around the proofmass down to a device layer such that the proofmass is coupled to the surrounding SOI wafer only by portions of the device layer surrounding the proofmass; and, coupling a contact plate to the SOI wafer adjacent the proofmass;

wherein the base is spaced apart from the SOI wafer such that the contact plate forms a gap with the first and second electrodes and the proofmass is designed to translate with respect to the surrounding SOI wafer such that the contact plate closes the gap under an acceleration and electrically connects the first and second electrodes.

10. The method of claim 9, wherein the switch is formed in a flip chip design.

11. The method of claim 9, further comprising forming a plurality of vias that provide electrical communication from the first and second electrodes through the base to an opposite side of the base from the first and second electrodes.

12. The method of claim 9, further comprising coupling a lid to the SOI wafer.

13. The method of claim 9, wherein the portions of the device layer surrounding the proofmass are substantially thinner than the proofmass.

14. The method of claim 9, wherein the portions of the device layer surrounding the proofmass are springs.

15. The method of claim 9, wherein the portions of the device layer surrounding the proofmass have a thickness defined by the device layer.

16. The method of claim 9, wherein the portions of the device layer surrounding the proofmass form discrete connections to the surrounding SOI wafer and other portions of the device layer surrounding the proofmass have been completely removed to form the discrete connections.

* * * * *